United States Patent [19]

Harker

[11] Patent Number: 4,936,375

[45] Date of Patent: Jun. 26, 1990

[54] CONTINUOUS CASTING OF INGOTS

[75] Inventor: Howard R. Harker, Malvern, Pa.

[73] Assignee: Axel Johnson Metals, Inc., Lionville, Pa.

[21] Appl. No.: 379,710

[22] Filed: Jul. 13, 1989

Related U.S. Application Data

[63] Continuation of Ser. No. 257,228, Oct. 13, 1988, abandoned.

[51] Int. Cl.[5] ..... B22D 11/10

[52] U.S. Cl. ..... 164/469; 164/489; 164/437; 164/506; 164/420

[58] Field of Search ..... 164/488, 489, 437, 438, 164/439, 133, 134, 337, 505, 506, 507, 466, 469, 494, 470, 420

[56] References Cited

U.S. PATENT DOCUMENTS 3,654,150 4/1972 Eccles ..... 164/134

4,027,722 6/1977 Hunt ..... 164/133

4,202,397 5/1980 Hlinka et al. ..... 164/437

*Primary Examiner*—Richard K. Seidel

*Attorney, Agent, or Firm*—Brumbaugh, Graves, Donohue & Raymond

[57] ABSTRACT

In the embodiments described in the specification, continuous casting of ingots is carried out by transferring molten metal from a hearth to a mold through one or more flow channels which provide flow paths having a shallow angle to the horizontal and which terminates adjacent to the surface of the molten metal in the mold so that the vertical velocity component of the stream of molten metal flowing into the mold is minimal and the horizontal velocity component is low. In one form, the hearth surrounds the mold, providing four shallow-angle flow channels uniformly spaced around the periphery of the mold to avoid unilateral introduction of the molten material into the mold.

20 Claims, 3 Drawing Sheets

CONTINUOUS CASTING OF INGOTS

This application is a continuation of application Ser. No. 257,228, filed on Oct. 13, 1988, now abandoned.

BACKGROUND OF THE INVENTION

This invention relates to casting of metal ingots and, more particularly, to a new and improved method and apparatus for continuous casting of ingots having uniform grain structure and to the ingots produced thereby.

For certain applications, such as components of aircraft engines and the like, it is important to obtain an ingot of metal alloy material which has a substantially uniform grain structure. Efforts have been made in the past to produce uniform ingots by various techniques. In the patents to Hunt, Nos. 4,583,580 and 4,681,787, for example, a continuous casting method is described in which the alloy to be continuously cast is heated in a cold hearth electron beam furnace and the temperature of the alloy and the hearth is controlled so as to maintain a solids content of about 15% to 40%. The molten mixture poured from the hearth to the casting mold thus has a high content of solid material, and it is poured into the mold with a substantial vertical velocity so as to distribute the liquid-solid mixture throughout the pool of molten material at the top of the mold. As a result, the mixture in the mold has a substantially thixotropic region with a solids content of at least 50%.

To prevent hot tears in the side walls of an ingot being cast continuously, the Lowe Patent No. 4,641,704 discloses vertical pouring of successive equal-volume quantities of molten material from a launder disposed above the top of the mold into the central portion of the mold at spaced time intervals with intermittent cooling and lowering of the ingot in the mold.

Another approach for providing uniform-grain ingots described, for example, in Hunt Patents Nos. 4,558,729 and 4,690,875, utilizes a rotating mold structure into which molten drops of the ingot material fall and solidify. The mold is maintained at a temperature which is below the solidus temperature of the ingot material, but above a temperature at which metallurgical bonding of the successive molten drops can occur, thereby producing an ingot without altering the grain size and distribution of the metal drops.

Such techniques are not only complicated and difficult to execute, but also place limitations on the size and shape and properties of the resulting ingot.

SUMMARY OF THE INVENTION

Accordingly, it is an object of the present invention to provide a new and improved continuous casting method and apparatus which overcomes the disadvantages of the prior art.

Another object of the invention is to produce a new and improved ingot by continuous casting which has a more uniform grain distribution.

A further object of the invention is to provide a continuous casting method and apparatus by which the formation of an ingot and the resulting ingot grain structure can be carefully controlled.

These and other objects of the invention are attained by providing a mold to receive molten material in an upper region and solidify the molten material to form an ingot in a lower region and introducing molten material into the mold at minimal vertical velocity so as to avoid disruption of the grain-forming and solidification process within the mold. To this end, the molten metal may be introduced from a hearth into the mold through a flow channel which has a shallow angle to the horizontal so as to provide relatively low velocity into the mold for the molten material. To provide a vertical velocity component which is lower than the horizontal, velocity component, the angle of the flow channel to the horizontal should be less than 45° based on vector analysis. Preferably, the angle of the flow channel to the horizontal is less than 35°, and most preferably it is less than 25°. In addition, the outlet of the flow channel should be at or below, or at most only slightly above, the level of the molten material in the mold, such as less than two inches and preferably less than one inch above that level. To avoid a high vertical velocity component of the molten metal flowing through the flow channel, the level of the hearth or other source from which the molten material flows into the flow channel is no more than about four inches and preferably no more than about two inches above the level of the molten material in the mold.

In one embodiment, the mold is surrounded by the hearth and a plurality of flow channels are provided to introduce molten metal at spaced intervals around the periphery of the mold, thereby providing even lower velocity of the molten material through each flow channel for a given total flow rate of molten material into the mold and avoiding unilateral flow of the molten material into the mold.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

In order to obtain improved continuous-cast ingots in accordance with the invention, it is important to control the rate and direction of flow of molten material into the mold. In the embodiment illustrated schematically in FIGS. 1 and 2, this is accomplished by utilizing a flow channel having a small angle to the horizontal which terminates at or just above the level of the molten metal in the mold. Preferably, the angle to the horizontal of the stream of molten material flowing through the flow channel is less than about 35°, and preferably it is less than 20°, and the end of the flow channel is no more than about two inches, and preferably no more than one inch, above the level of the molten material in the mold. Alternatively, the mold may be designed so that the side wall of the mold forms part of the flow channel, permitting the molten metal to be introduced into the mold below the top surface of the molten metal in the mold.

Figure 1:
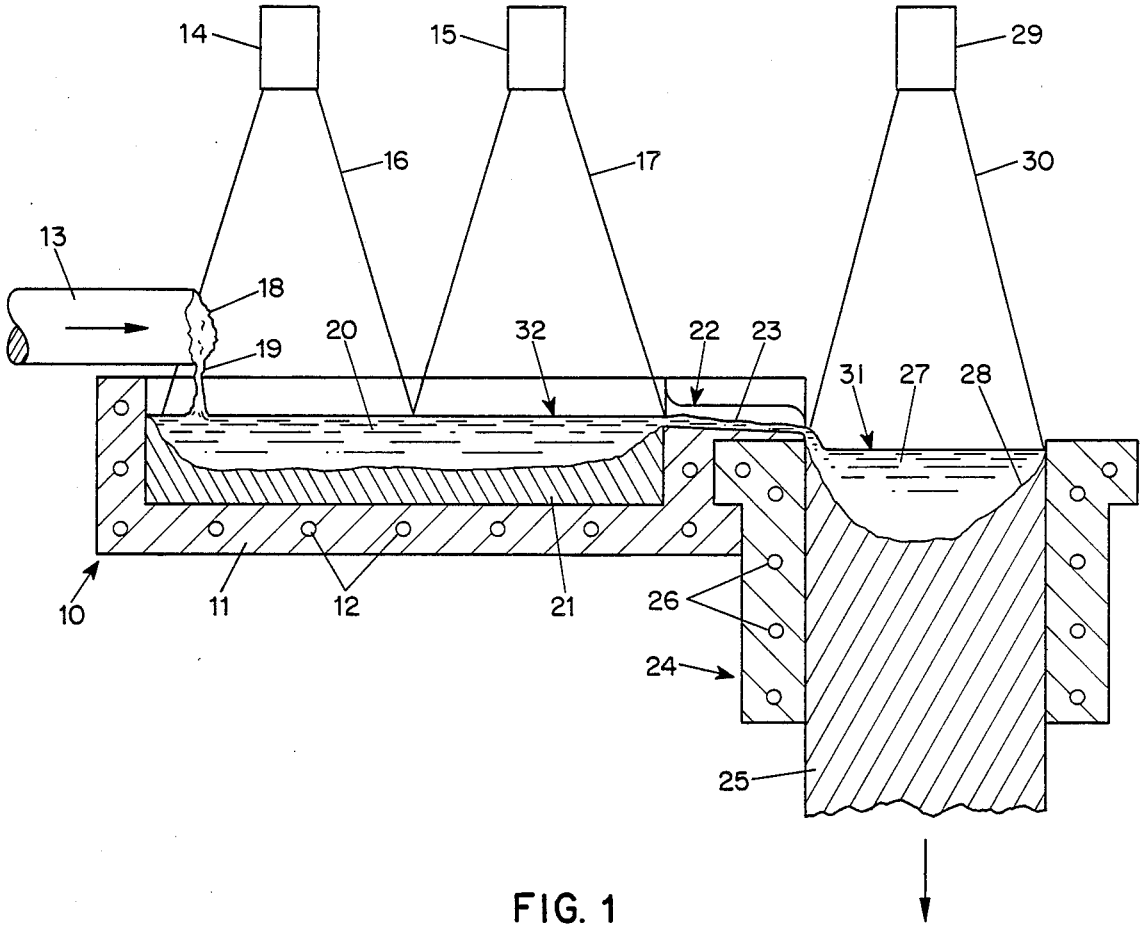
FIG. 1 is a schematic view in longitudinal section illustrating a representative ingot-casting arrangement in accordance with the invention.
Figure 2:
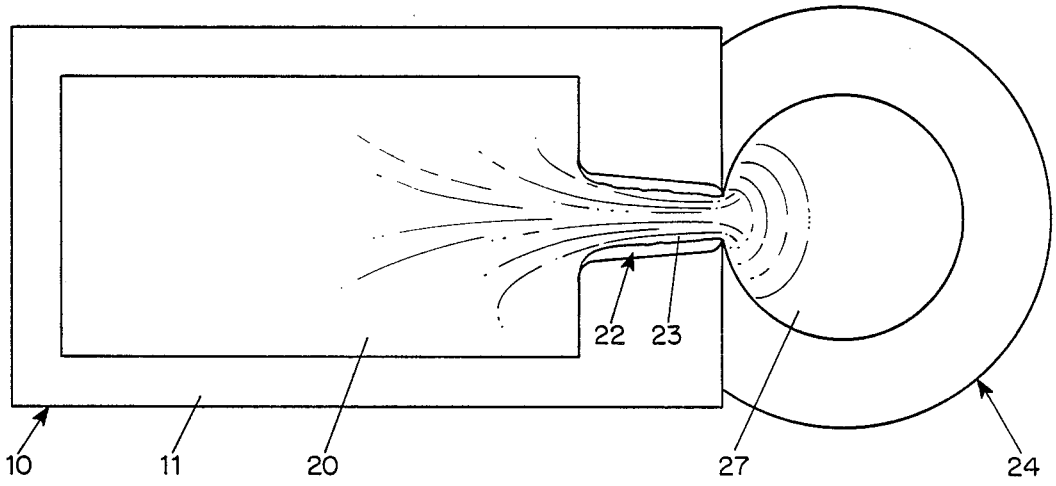
FIG. 2 is a plan view of the arrangement illustrated in FIG. 1.

In the embodiment shown in FIGS. 1 and 2, a hearth 10 comprises a hearth bed 11 containing cooling pipes 12 through which water or another cooling liquid may be circulated. At the inlet end of the hearth, a bar 13 of metal alloy to be refined and cast into an ingot is moved continuously toward the hearth in the usual manner as indicated by the arrow. Alternatively, the raw material supplied to the hearth 10 may be in particulate form, such as small fragments or compacted briquettes of the material to be refined and cast into an ingot.

Two directionally controllable energy input devices 14 and 15, such as conventional electron beam guns or plasma torches, are mounted above the hearth 10 and arranged to direct energy toward the hearth in controllable patterns 16 and 17, respectively, as required to melt and refine the metal to be cast. If the energy input devices 14 and 15 are electron beam guns, the mold and hearth are enclosed in a vacuum housing in the usual manner. The inner end 18 of the bar 13 of metal to be refined is melted in the usual manner by energy received from the energy input device 14, producing a stream 19 of molten material flowing into the hearth 10 to provide a pool 20 of molten material therein. Because the hearth bed 11 is cooled by liquid flowing through the pipes 12, a solid skull 21 is formed on the inner surface of the hearth bed, protecting it from degradation by the molten metal.

At the opposite end of the hearth 10, a flow channel 22 is formed by an opening in the hearth wall, permitting a stream 23 of molten material to flow from the hearth into a mold 24 in which the metal is solidified into an ingot 25 as a result of cooling liquid circulated through pipes 26 in the mold. The ingot 25 is withdrawn downwardly from the mold 24 in the direction of the arrow in the usual manner and, in order to assure a uniform grain structure and composition, the ingot should be withdrawn continuously at a substantially uniform rate corresponding to the rate of introduction of molten metal into the mold through the flow channel 23.

The molten metal introduced into the mold forms a pool 27 at the top of the mold having a cup-shaped interface 28 with the material in the ingot which has been solidified by cooling within the mold. In order to maintain the pool 27 at a desired temperature, another directionally controllable energy input device 29, such as a conventional electron beam gun or a plasma torch, directs a controllable beam of energy 30 toward the molten metal in the pool 27. As the metal in the pool 27 is cooled within the mold, crystallites form within the pool, producing dendrites which break off and fall to the interface 28. In addition, dendrites tend to form at the interface 28 and the grain structure formed within the ingot 25 depends upon the size and distribution of the dendrites formed by the crystallites and at the interface 28 as the molten metal solidifies. Consequently, the introduction of molten metal at substantial vertical velocity and in a nonuniform manner into the pool 27 disturbs the growth and distribution of the dendrites within the pool and along the interface 28, causing an undesired nonuniform grain distribution in the resulting ingot.

To avoid this condition in accordance with the invention, as illustrated in the embodiment shown in FIGS. 1 and 2, the molten material is introduced from the pool 20 in the hearth 10 into the mold 24 at minimal vertical velocity, and preferably at a relatively low horizontal velocity to minimize such disturbance of the grain distribution. This is accomplished by providing a flow channel 22 providing a shallow path for the molten metal 23 which terminates at or just above the level of the surface 31 of the pool 27 in the mold. The angle to the horizontal of the stream 23 of molten metal in the flow channel should be less than 35°, and preferably, it should be less than 20°.

Moreover, to avoid excessive horizontal velocity of the stream 23 of molten material flowing from the hearth through the flow channel into the mold, the difference between the level 31 of the molten material in the mold and the level 32 of the molten material in the hearth is kept as small as possible. Preferably, the total distance between the level 31 in the mold and the level 32 in the hearth is less than four inches and, more desirably, less than two inches, and the distance between the end of the flow channel 22 and the level 31 of the molten material in the mold is less than about two inches, and preferably less than one inch. Preferably, the depth of the stream 23 of molten metal in the flow channel 22 is less than about one inch.

Figure 3:
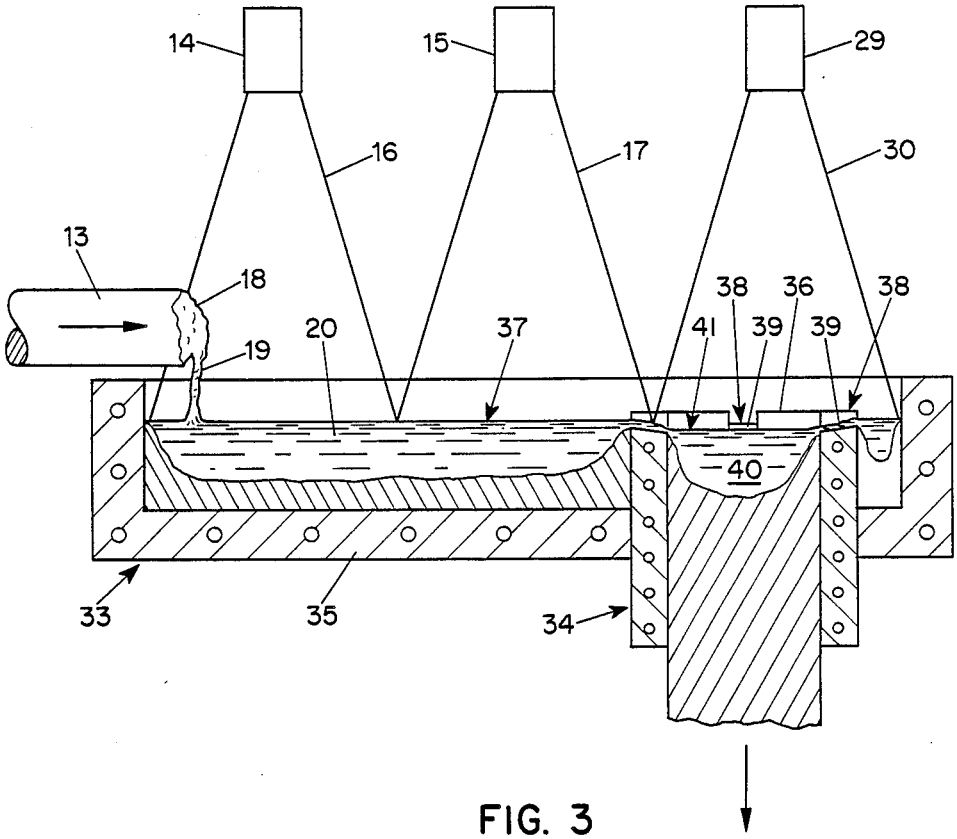
FIG. 3 is a schematic view in longitudinal section illustrating another embodiment of a casting arrangement in accordance with the invention.
Figure 4:
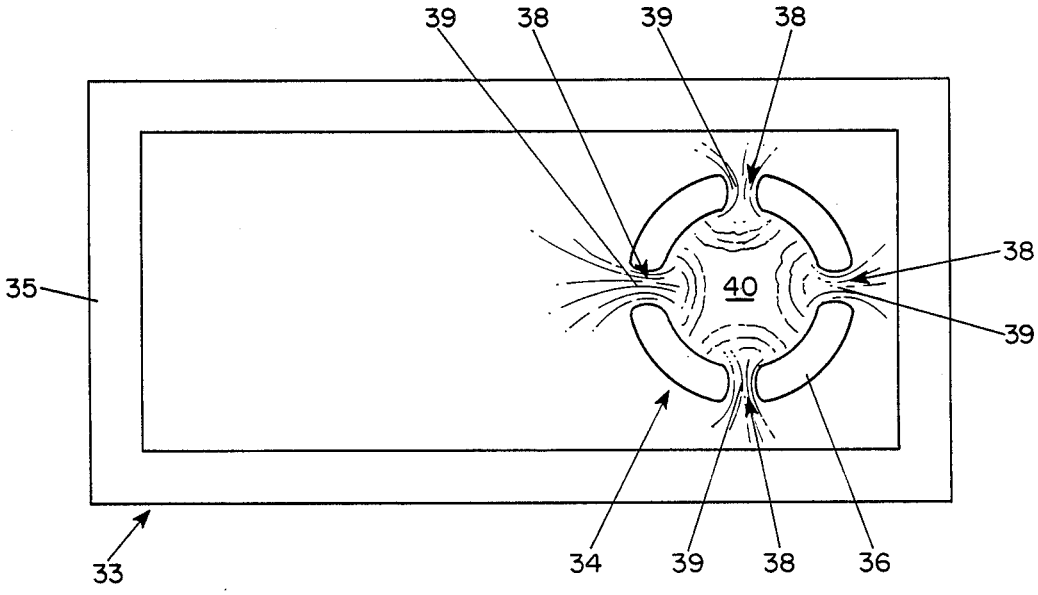
FIG. 4 is a plan view of the embodiment illustrated in FIG. 3.
Figure 5:
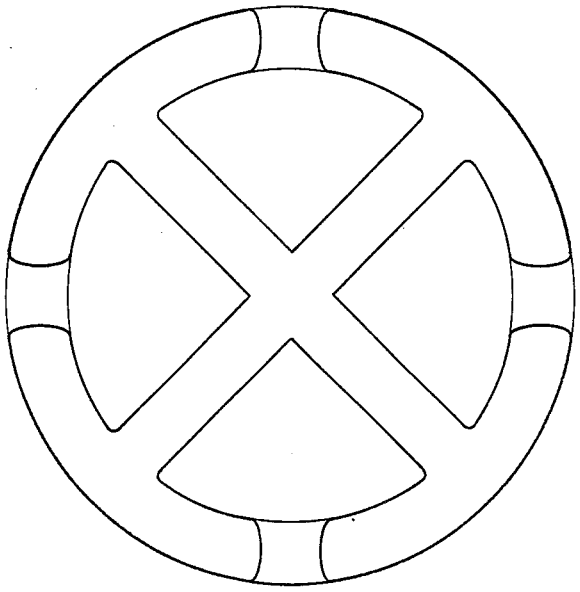
FIG. 5 is a plan view of a mold arranged to provide a plurality of ingots in accordance with the invention.

Another embodiment of the invention is illustrated in FIGS. 3 and 4 in which corresponding parts are identified by the same reference numerals as in FIGS. 1 and 2. In this case, a hearth 33 is constructed with a mold 34 mounted in the hearth bed 35 and having its upper end 36 extending above the level 37 of the molten material in the hearth. In the embodiment shown in FIGS. 3 and 4, the upper end 36 of the mold is formed with four openings 38 shaped as wide, shallow-angle flow channels to direct molten metal 39 from the pool of molten metal 20 into the hearth to a pool 40 of molten metal at the top of the mold 34. With this arrangement, the molten metal is introduced not only at minimal vertical velocity and low horizontal velocity, but also uniformly toward all sides of the pool 40 within the mold, thereby avoiding any unilateral disturbance of the molten metal in the pool. In addition, because the mold is built into the hearth, the flow channels 38 can have shorter dimensions and provide wider, shallower paths for the streams 39 of molten metal and the level 41 of the molten metal in the mold can be kept closer to the level 37 of the molten metal in the hearth, such as, for example, less than one inch, while still providing the desired flow rate of molten metal into the mold. Furthermore, multiple-strand casting is accomplished more effectively with a mold of the type illustrated in FIGS. 3 and 4. FIG. 5 illustrates a mold similar to that of FIGS. 3 and 4 arranged to cast a plurality of strands to produce a plurality of ingots simultaneously.

Introduction of molten metal into a mold for continuous casting at a relatively low horizontal velocity and minimal vertical velocity in accordance with the invention reduces the nonuniformity of macrostructure of the ingot produced by the casting so as to provide an ingot having a more desirable internal structure. In addition, such uniform low velocity flow improves the surface condition of the ingot, avoiding nonuniform cooling and solidification conditions which tend to cause surface defects in the ingot.

Although the invention has been described herein with reference to specific embodiments, many modifications and variations therein will readily occur to those skilled in the art. Accordingly, all such variations and modifications are included within the intended scope of the invention.

I claim:

1. A method for continuous casting of a metal ingot comprising providing a mold to receive molten metal in an upper portion and solidify molten metal into an ingot which is withdrawn from a lower portion of the mold, and introducing molten metal downwardly into the mold from a location above the surface of the molten metal in the mold in a stream which is received at the surface of the molten metal in the mold and has a lower vertical velocity component than its horizontal velocity component to inhibit disruption of dendrites formed below the surface of the molten metal in the mold.

2. A method according to claim 1 including the step of introducing molten metal into the mold through a path disposed at an angle of no more than about 35° to the horizontal.

3. A method according to claim 2 wherein the angle of the path is no more than about 20° to the horizontal.

4. A method according to claim 1 including introducing the molten metal into the mold through a flow channel which forms a stream of molten metal which terminates adjacent to the upper surface of the molten metal in the mold.

5. A method according to claim 4 wherein the depth of the stream in the flow channel is no more than about one inch.

6. A method according to claim 1 wherein the stream of molten metal is introduced into the mold through a flow channel and the end of the flow channel adjacent thereto is no more than about two inches above the upper surface of the molten metal in the mold.

7. A method according to claim 6 wherein the end of the flow channel adjacent to the mold is no more than about one inch above the upper surface of the molten metal in the mold.

8. A method according to claim 1 wherein the stream of molten metal flows to the mold from a hearth through a flow channel and wherein the level of the molten metal in the hearth is no more than about four inches above the level of the molten metal in the mold.

9. A method according to claim 8 wherein the level of the molten metal in the hearth is no more than about two inches above the level of the molten metal in the mold.

10. A method for continuous casting of a metal ingot comprising providing a mold to receive molten metal in an upper portion and solidify molten metal into an ingot which is withdrawn from a lower portion of the mold, and introducing molten metal downwardly into the mold in a stream which is received at the surface of the molten metal in the mold and has a lower vertical velocity component than its horizontal velocity component including providing a plurality of flow channels at spaced intervals around the periphery of the mold and introducing molten metal into the mold in a plurality of streams passing through the plurality of flow channels to avoid unilateral flow of molten metal into the mold.

11. A method according to claim 10 including forming a plurality of ingots simultaneously within the mold.

12. Apparatus for continuous casting of metal ingots comprising a hearth for heating and maintaining molten metal having an outlet for the molten meal, a mold adapted to receive molten metal in an upper portion thereof which is below the hearth outlet, cooling means for solidifying the molten metal in the mold to produce a solid ingot which is withdrawn from a lower portion of the mold, and flow channel means extending downwardly from the hearth outlet at an angle of less than 45° to horizontal toward the location of the surface of molten metal in the mold providing a downward flow path for molten metal from the hearth outlet toward the surface of molten metal in the mold at a rate which has a lower vertical velocity component than horizontal velocity component to inhibit disruption of dendrites formed below the surface of the molten metal in the mold.

13. Apparatus according to claim 12 wherein the flow channel means provides a flow path for molten metal which is disposed at an angle of no more than about 35° to the horizontal.

14. Apparatus according to claim 13 wherein the flow channel means provides a flow path for molten metal which is disposed at an angle of no more than about 20° to the horizontal.

15. Apparatus according to claim 12 wherein the flow channel means terminates at the mold at a location no more than about two inches above the level of the molten metal in the mold.

16. Apparatus according to claim 15 wherein the flow channel means terminates no more than about one inch above the level of the molten material in the mold.

17. Apparatus according to claim 12 wherein the flow channel means forms a stream of molten metal which has a depth no greater than about one inch.

18. Apparatus according to claim 12 wherein the flow channel means comprises a plurality of channels providing a corresponding plurality of flow paths for molten metal distributed at spaced intervals around the periphery of the mold.

19. Apparatus according to claim 12 including hearth means for supplying molten metal to the mold and wherein the upper portion of the mold is surrounded by the hearth means.

20. Apparatus according to claim 19 wherein the flow channel means comprises a plurality of channels providing a corresponding plurality of flow paths between the hearth means and the mold.

* * * * *